US005142747A

United States Patent [19]

Matsushima

[11] Patent Number: 5,142,747

[45] Date of Patent: Sep. 1, 1992

[54] STRUCTURE OF COUPLING HEAD PORTION FOR COILED SLIDE FASTENER ELEMENT

[75] Inventor: Haruo Matsushima, Toyama, Japan

[73] Assignee: Yoshida Kogyo K.K., Tokyo, Japan

[21] Appl. No.: 725,464

[22] Filed: Jul. 3, 1991

[30] Foreign Application Priority Data

Jul. 3, 1990 [JP] Japan ..... 2-176699

[51] Int. Cl.[5] ..... A44B 19/12

[52] U.S. Cl. ..... 24/391; 24/392

[58] Field of Search ..... 24/391, 392, 394, 396

[56] References Cited

U.S. PATENT DOCUMENTS 3,248,767 5/1966 Hansen ..... 24/391
4,034,444 7/1977 Moertil ..... 24/394
4,126,158 11/1978 Scott ..... 24/392 X

FOREIGN PATENT DOCUMENTS 1260218 2/1968 Fed. Rep. of Germany ..... 24/391

*Primary Examiner*—Laurie K. Cranmer
*Attorney, Agent, or Firm*—Hill, Van Santeen, Steadman & Simpson

[57] ABSTRACT

A coiled slide fastener element made of a synthetic resin monofilament has a coupling head portion, which has an enlarged width by forming bulging portions so that firm coupling of a slide fastener can be realized.

1 Claim, 3 Drawing Sheets

STRUCTURE OF COUPLING HEAD PORTION FOR COILED SLIDE FASTENER ELEMENT

BACKGROUND OF THE INVENTION

1. Field of the Invention

This invention relates to a coiled slide fastener element produced by bending a monofilament of synthetic resin, and more particularly to the structure of a coupling head portion for such a coiled slide fastener element.

2. Description of the Related Art

There are currently known a variety of coupling head portions for such slide fasteners which are produced by stamping a monofilament or pressing the monofilament by using force to wind the monofilament around a substantially square mandrel, for example. In these methods, the coupling head portion is formed by bending and pressing the monofilament by applying force.

One example of such a coupling head portion is shown in FIGS. 7 and 8 of the accompanying drawings. A coupling head portion 12 is small in thickness, and bulging portions 13 have steep slopes 14.

With this coupling head portion, the slopes of the bulging portions are recessed as shown by a solid line in FIG. 8. Preferably these slopes should be gentle or curved as shown by a double-dot line in FIG. 8. Conventionally, these slopes are rather deeply recessed, thereby making the coupling head portion small in size and in thickness. When a pair of mating coupling elements of a slide fastener are coupled, such coupling head portions have somewhat weak lateral coupling force, and tend to be disengaged if pulled strongly in the lateral direction.

SUMMARY OF THE INVENTION

With the foregoing problems in view, it is therefore an object of this invention to provide a structure of a coupling head portion for a slide fastener element which is resistant to lateral pulling force.

According to this invention, there is provided a structure of a coupling head portion for a slide fastener element made by bending a monofilament of synthetic resin. The structure is characterized in that bent portions at an inner side of the coupling head portion and bulging portions are substantially semi-circular in cross section and confront each other via flat portions thereof which are nearly or actually in contact with each other.

With this arrangement, the bulging portions at the coupling head portion are mount-like with full and round slopes and large in thickness, thereby enlarging the coupling area and increasing the coupling force of the coupling head portion.

DETAILED DESCRIPTION

Figure 1:
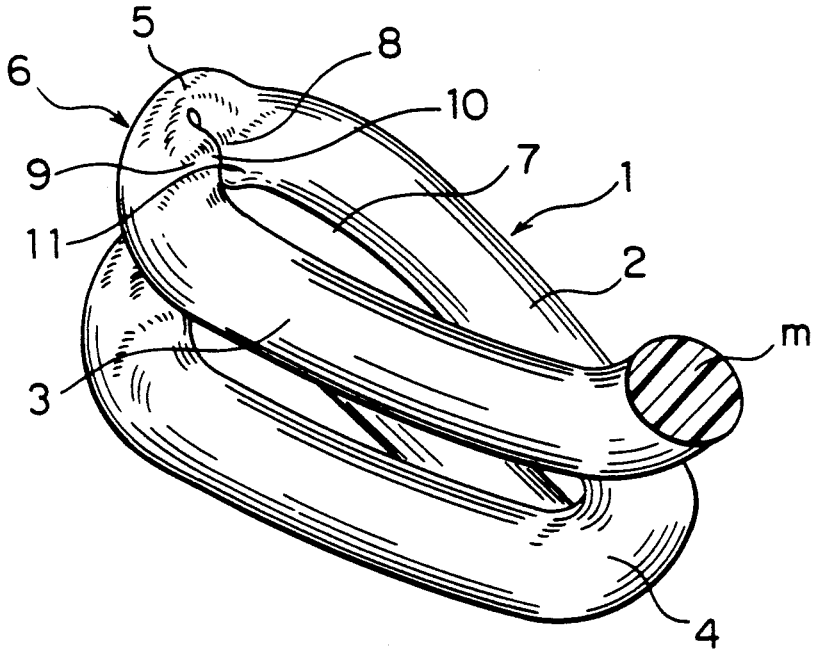
FIG. 1 is a perspective view showing a part of a coiled slide fastener coupling element according to one embodiment of this invention.
Figure 6A:
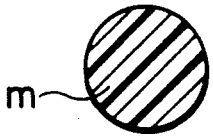
FIGS. 6(A) and 6(B) are cross-sectional views of monofilaments.
Figure 6B:
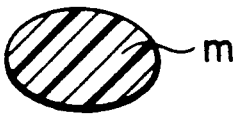
Figure 7:
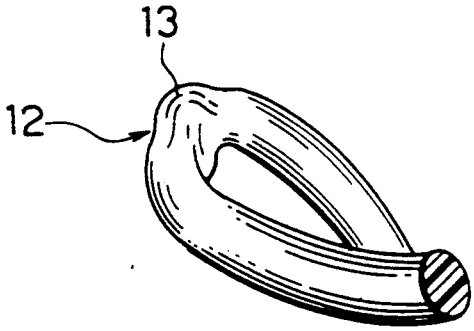
FIG. 7 (PRIOR ART)
FIG. 7 is a perspective view showing a part of a conventional slide fastener element.
Figure 8:
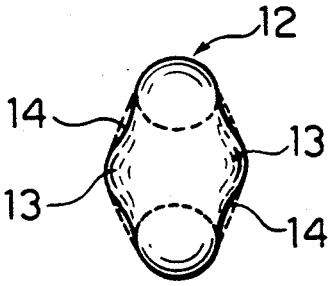
FIG. 8 (PRIOR ART)
FIG. 8 is a front elevational view of the slide fastener element of FIG. 7.

One embodiment of this invention will now be described with reference to FIGS. 1 to 4. As shown in FIG. 1, a coiled slide fastener element 1, which is made by bending a monofilament of synthetic resin, comprises an upper leg portion 2, a coupling head portion 6, a lower leg portion 3, and a connecting portion 4, all of which are formed in succession by turning and bending the monofilament. The coupling head portion 6 includes bulging portions 5 and bent portions 8, 9. An inner side of the coupling head portion 6 and the upper and lower leg portions forms a hollow space 7 for receiving a mating coupling head portion. The monofilament m composing the coiled slide faster element 1 is either circular or oval in the cross section as shown in FIG. 6(A) or 6(B).

The circular or oval monofilament m is turned and bent to form the coupling head portion 6. At the coupling head portion 6, the monofilament becomes substantially semi-circular in the cross section, taken along line III—III in FIG. 2, as shown in FIG. 3, and serve as bent portions 8, 9. The bent portions 8, 9 confront each other via their flat portions 10, 11 which are nearly or actually in contact with each other. The monofilament is pressed at the inner side of the coupling head portion to form bulging portions 5 on opposite sides of the coupling head portion 6. The bulging portions 5 are mount-like with gentle slopes and large in thickness, thereby increasing the coupling area of the coupling head portion to realize firm coupling.

Figure 2:
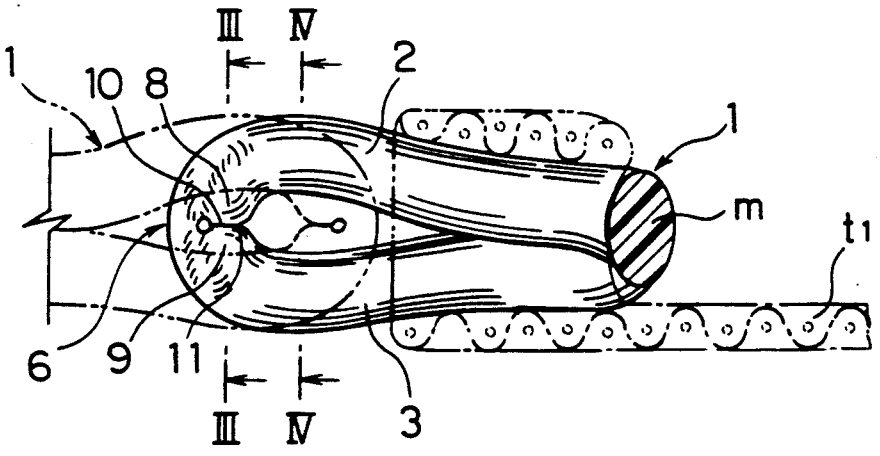
FIG. 2 is a side elevational view of the slide fastener element of FIG. 1.
Figure 3:
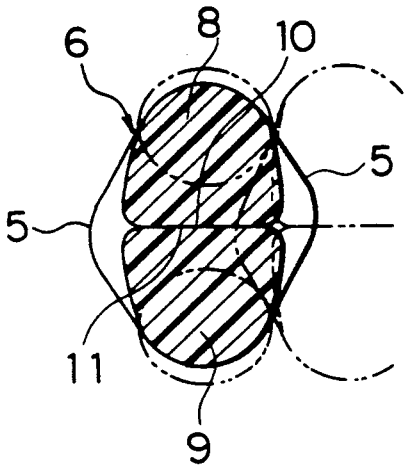
FIG. 3 is an enlarged cross-sectional view taken along line III—III of FIG. 2.
Figure 4:
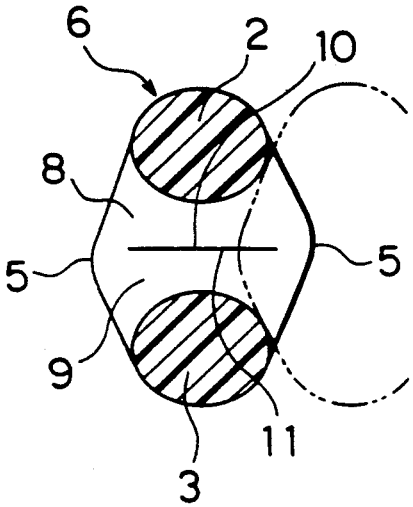
FIG. 4 is an enlarged cross-sectional view taken along line IV—IV of FIG. 2.
Figure 5:
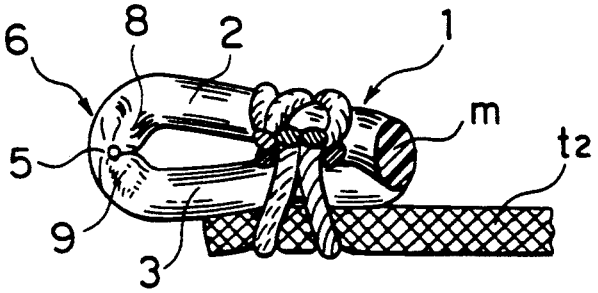
FIG. 5 is a side elevational view showing one example of a fastener stringer using the slide fastener element of this invention.

The coiled slide fastener element 1 of the foregoing structure may be woven into a fastener tape t1 during weaving as shown in FIG. 2, or may be attached to a slide fastener tape t2 by sewing or by weaving as shown in FIG. 5.

According to this invention, the coupling head portion has an enlarged width due to the bulging portions which are gently sloped, so that firm coupling of a slide fastener can be realized. Therefore, the slide fastener can remain coupled even when a strong lateral pulling force is applied thereto.

What is claimed is:

1. A coiled slide fastener element made by bending a monifilament of synthetic resin so as to have an upper leg portion, a coupling head portion, a lower leg portion, and a connecting portion in succession, wherein said coupling head portion comprises:

bent portions on an inner side of said coupling head portion, each of said bent portions terminating in bulging portions on opposite sides of said coupling head portion;

said bent portions being substantially semi-circular in cross-section and confronting each other via flat portions thereof, said flat portions being substantially in contact with each other;

wherein said bulging portions are relatively thick, and have a gently-sloped, non-recessed contour; and whereby said contour and thickness of said bulging portions increases the coupling area of said coupling head portion.

* * * * *